US005292239A

United States Patent [19]

Zeldin et al.

[11] Patent Number: 5,292,239

[45] Date of Patent: Mar. 8, 1994

[54] APPARATUS FOR PRODUCING NONWOVEN FABRIC

[75] Inventors: Leon M. Zeldin, Greer; John V. Francis, Taylors, both of S.C.; Jean-Pierre R. Vuillet, Mulhouse, France

[73] Assignee: Fiberweb North America, Inc., Simpsonville, N.C.

[21] Appl. No.: 891,723

[22] Filed: Jun. 1, 1992

[51] Int. Cl.[5] ..... D04H 3/03

[52] U.S. Cl. ..... 425/66; 156/167; 156/441; 425/72.2; 425/83.1

[58] Field of Search ..... 156/167, 181, 441, 494; 19/299; 65/7, 16; 425/7, 66, 72.2, 464, 83.1; 264/12, 211.12, 210.8

[56] References Cited

U.S. PATENT DOCUMENTS

| | | | |
|---|---|---|---|
| 3,352,653 | 11/1967 | Speth | 65/7 |
| 3,357,808 | 12/1967 | Eberle | 65/7 |
| 3,379,811 | 4/1968 | Hartmann | 425/464 |
| 3,802,817 | 4/1974 | Matsuki et al. | 425/66 |
| 4,064,605 | 12/1977 | Akiyama et al. | 425/66 |
| 4,322,027 | 3/1982 | Reba | 19/299 |
| 4,340,563 | 7/1982 | Appel et al. | 425/66 |
| 4,405,297 | 9/1983 | Appel et al. | 425/66 |
| 4,813,864 | 3/1989 | Balk | 425/72.2 |
| 4,961,695 | 10/1990 | Hirschmann et al. | 425/72.2 |

FOREIGN PATENT DOCUMENTS

| | | | |
|---|---|---|---|
| 0049563 | 4/1982 | European Pat. Off. . | |
| 0377926 | 7/1990 | European Pat. Off. . | |
| 230541 | 4/1991 | European Pat. Off. . | |
| 1660318 | 3/1970 | Fed. Rep. of Germany . | |
| 128204 | 11/1977 | Fed. Rep. of Germany . | |
| 59775 | 5/1977 | Japan | 156/167 |
| 1107861 | 3/1968 | United Kingdom . | |

*Primary Examiner*—Geoffrey L. Knable
*Assistant Examiner*—Steven D. Maki
*Attorney, Agent, or Firm*—Bell, Seltzer, Park & Gibson

[57] ABSTRACT

An apparatus and method are disclosed for forming a nonwoven fabric web, such as a spunbond web. The apparatus comprises a spinneret for downwardly extruding a curtain of filaments, and an underlying air drawing unit for drawing and attenuating the filaments as they move downwardly therethrough. A conveyor belt receives the drawn filaments and forms the filaments into a nonwoven fabric web. In the drawing unit, the filaments pass downwardly through a slot, and a pair of air nozzles are positioned in the slot, with one nozzle being positioned adjacent each side wall of the slot. The nozzle outlets are oriented so as to introduce each of the air streams into the slot in a direction which is parallel to the side walls of the slot, and the introduced air streams act to draw additional air into the open upper end of the slot. The drawn-in air and the air introduced by the two nozzles collectively form a substantially non-turbulent flow at their juncture and along the remainder of the vertical length of the slot, and this smooth air flow serves to draw the filaments without imparting turbulence to the filaments, which in turn produces filaments which are uniformly drawn and thus of uniform denier.

17 Claims, 4 Drawing Sheets

APPARATUS FOR PRODUCING NONWOVEN FABRIC

BACKGROUND OF THE INVENTION

The present invention relates to an apparatus and method for the production of a nonwoven fabric, such as a spunbond fabric web, from thermoplastic polymers, such as polypropylene, polyethylene, polyester, nylon, and blends thereof.

Processes of the described type are known which include the steps of melting the polymer, extruding the polymer through a spinneret to form a vertically oriented curtain of downwardly advancing filaments, and then air quenching the filaments. The advancing curtain is then passed through a suction type drawing or attenuating air slot, wherein compressed air is introduced into the slot so as to draw air into the upper open end of the slot and form a rapidly moving downward stream of air in the slot. A drawing force is thereby imparted to the filaments, and upon exiting at the bottom of the slot, the filaments are deposited on a moving conveyor belt to form a continuous web. The filaments of the web are then joined to each other at their contact points by any one of several known techniques. Apparatus and processes of this general type are further disclosed for example in U.S. Pat. Nos. 3,802,817 and 4,064,605, and published EPO Application 0 230 541.

While the known apparatus and processes are satisfactory in many respects, it is recognized that the uniformity of the denier and tensile properties of the filaments are not as consistent as is desirable, and that the uniformity and quality of the resulting fabric web is accordingly deficient for many end uses.

It is accordingly an object of the present invention to provide an apparatus and method for the production of a nonwoven fabric web composed of filaments having essentially uniform denier and tensile properties.

It is a more particular object of the present to provide an apparatus and method of the described type and wherein the freshly extruded filaments are drawn by means of a force imparted in a suction type air slot and under conditions which impart an essentially uniform draw to the filaments, and such that the filaments have an essentially uniform denier and tensile properties.

SUMMARY OF THE INVENTION

The above and other objects and advantages of the present invention are achieved in the embodiments illustrated herein by the discovery that the manner and direction in which the compressed air is introduced into the slot of the drawing unit has a significant effect on the uniformity of the denier and tensile properties of the filaments. More particularly, it has been found that the quality of the web, and specifically the uniformity of the denier and the tensile properties of the filaments can be significantly enhanced by introducing the compressed air in a direction essentially parallel to the walls of the slot, and so as to generate a relatively non-turbulent flow at the juncture of the induced air and the entering compressed air, and along the remaining vertical length of the slot.

More particularly, and in accordance with the preferred embodiment of the invention, the method and apparatus comprises a melt spinning means including a spinneret for extruding a substantially vertical curtain of polymeric filaments, and an elongate drawing slot positioned below the spinneret for receiving the filaments therein. The slot includes a horizontally directed elongate open upper end, and opposing side walls depending substantially vertically downwardly from the open end. In addition, a nozzle communicates with at least one of the side walls at a medial location along the vertical length of the slot for introducing a downwardly directed stream of air into the slot along substantially the entire length of the slot at a location immediately adjacent the one side wall and in a direction which is essentially parallel to the one side wall, and such that air is drawn into the upper end of the slot. The drawn-in air and the air introduced by the nozzle collectively form a relatively non-turbulent flow of air along the vertical length of the slot which exerts a drawing force on the filaments as they pass vertically through the slot. A moving belt is positioned below the slot for receiving the sheet of filaments and forming the same into a nonwoven fabric web.

In accordance with the preferred embodiment, it is believed that the absence of significant turbulence in the air flow serves to uniformly and consistently apply the drawing force to the filaments, resulting in a uniform and predictable draw of the filaments.

In the preferred embodiment, a nozzle is positioned along each of the side walls of the slot, with each of the nozzles being adapted for introducing a downwardly directed stream of air at a location immediately adjacent the associated side wall. By this arrangement, the injected air tends to support the filaments centrally between the air streams entering from the nozzles, and so as to minimize contact between the filaments and the side walls.

As used in the present application, the phrase "essentially parallel to the walls of the slot" means that the stream of rapidly moving air entering the slot from the nozzle enters at an angle of no more than about 2° from the direction of the side wall, and preferably less than 1° from the direction of the side wall, when viewed in transverse cross section.

BRIEF DESCRIPTION OF THE DRAWINGS

Some of the objects and advantages of the prevent invention having been stated, others will appear as the description proceeds, when taken in conjunction with the accompanying drawings, in which.

DETAILED DESCRIPTION OF THE PREFERRED EMBODIMENT

Figure 1:
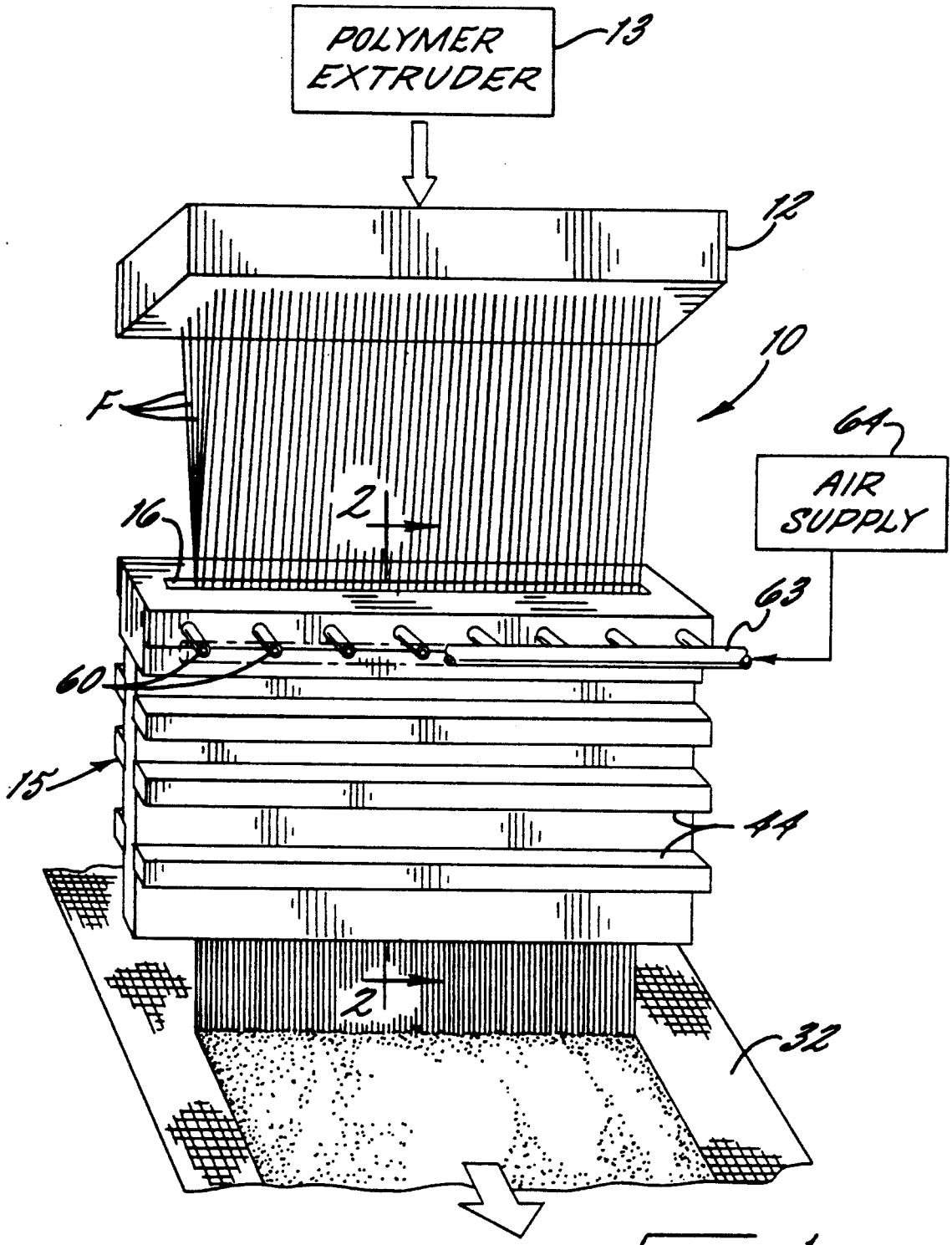
FIG. 1 is a front perspective view of a melt spinning apparatus which embodies the features of the present invention.

Referring more particularly to the drawings, FIG. 1 illustrates an apparatus at 10 which embodies the features of the present invention, and which comprises a spinneret 12 for extruding a substantially vertical curtain of polymeric filaments F. The spinneret 12 is conventional, and it is supplied with a heated and plasticized polymer by an extruder 13 in the conventional manner.

Figure 4:
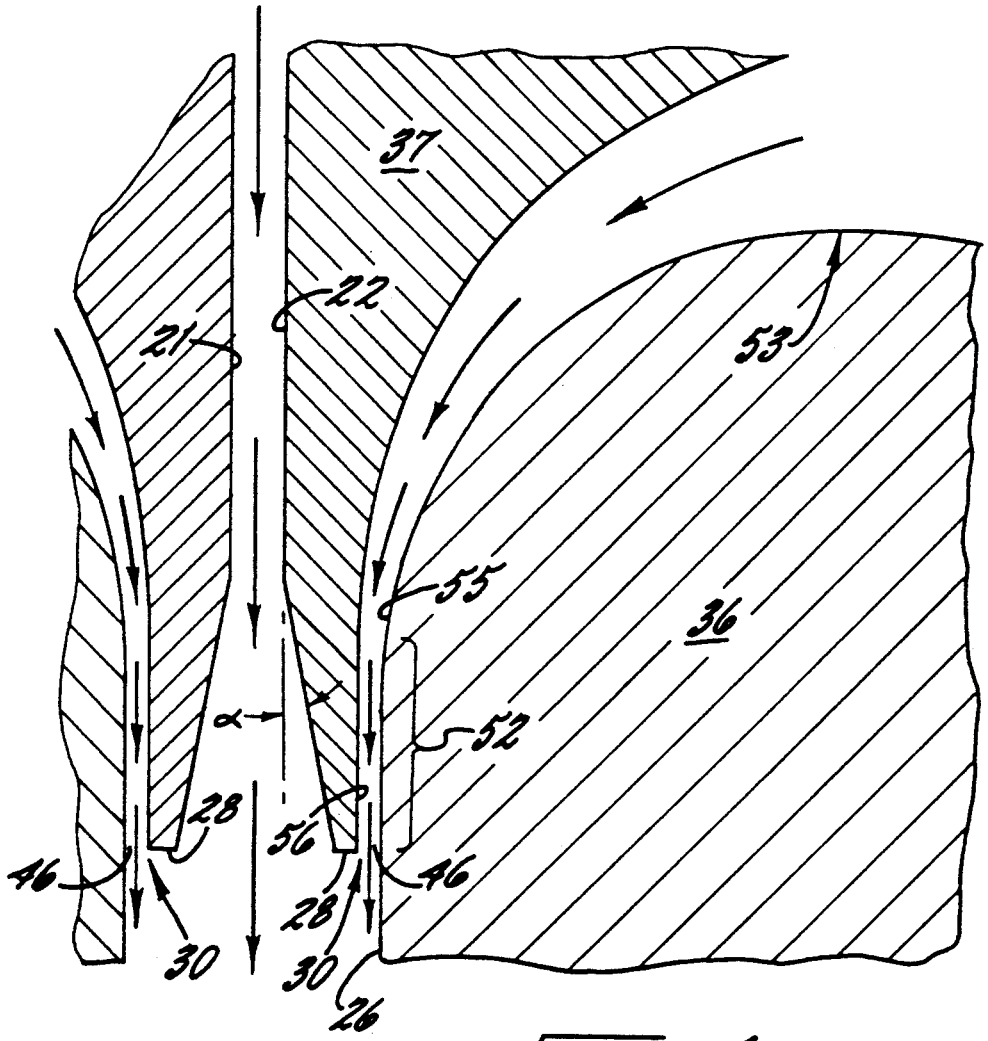
FIG. 4 is a fragmentary and further enlarged view of the upper portion of the slot as seen in FIG. 2.

The filaments advance downwardly through an open air space below the spinneret, which serves to cool and at least partially solidify the filaments. The filaments next pass vertically downwardly through a drawing unit 15, which includes an elongate slot 16 which is aligned below the spinneret 12 for receiving the curtain of filaments F. The slot 16 includes a horizontally directed elongate open upper end 18, and an upper slot segment 20 depending from the upper end 18 and which comprises a pair of closely spaced apart, vertically directed upper side wall segments 21 22. The slot 16 further includes a lower slot segment 24 which depends from the upper slot segment 20 and comprises a pair of relatively widely spaced apart, vertically directed lower side wall segments 25, 26. As best seen in FIG. 4, a transverse shoulder 28 is positioned between the upper and lower slot segments 20, 24 on each side of the slot.

The drawing unit 15 further comprises a nozzle 30 which communicates with each of the shoulders 28. Each of the nozzles 30 is adapted for introducing a downwardly directed rapidly moving stream of air into the slot 16 along substantially the entire longitudinal length of the slot and at a location immediately adjacent the associated lower side wall segment 25, 26. Further, each nozzle 30 acts to introduce the air along a direction which is essentially parallel to the associated lower side wall segment 25, 26. By this construction, air is drawn or sucked into the upper end 18 of the slot, and the drawn in air and the air introduced by the two nozzles collectively form a relatively non-turbulent flow along the vertical length of the slot which exerts a drawing force on the filaments F as they pass vertically through the slot.

The apparatus 10 further comprises a moving conveyor belt 32 positioned below the slot of the drawing unit 15 for receiving the filaments F and forming the same into a nonwoven fabric web in the conventional manner. The fabric web may be subjected to a further and conventional process for bonding the filaments of the web to each other at their contact points.

Figure 2:
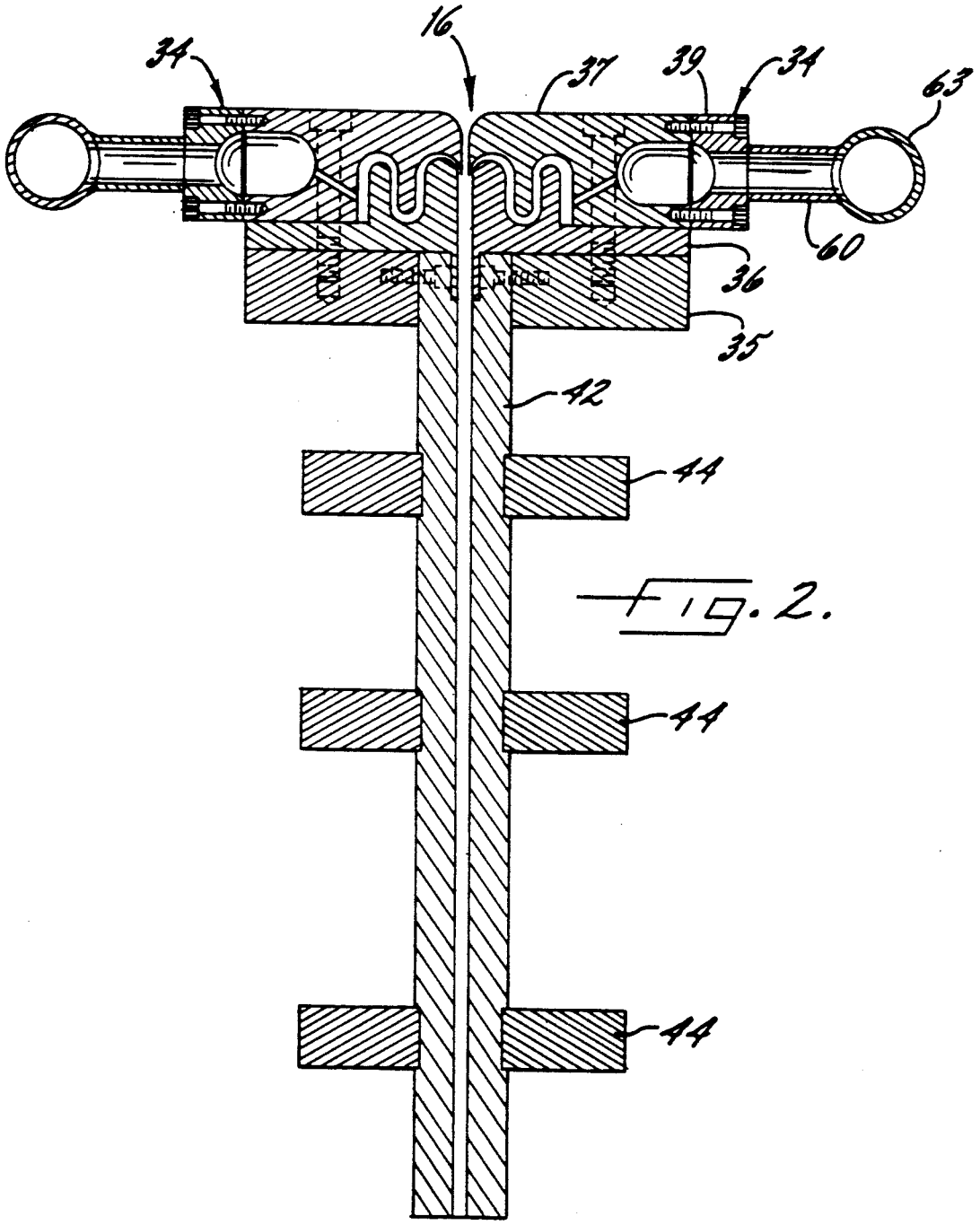
FIG. 2 is a vertical sectional view of the drawing unit taken substantially along the line 2—2 of FIG. 1, and with the filaments omitted for clarity of illustration.
Figure 3:
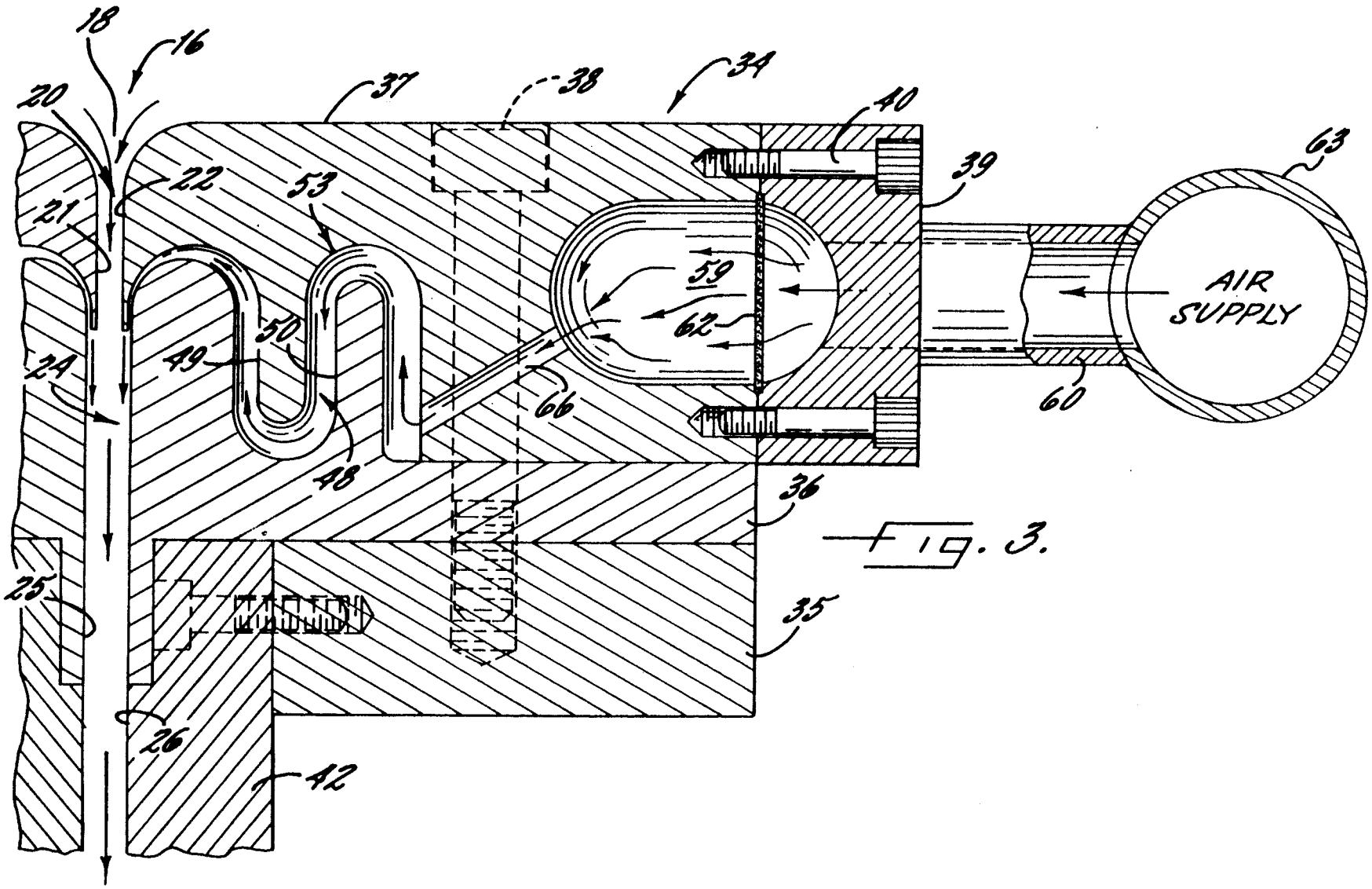
FIG. 3 is an enlarged fragmentary view of the upper portion of the drawing unit as seen in FIG. 2.

As best seen in FIGS. 2 and 3, the drawing unit 15 is composed of several structural members which are interconnected by bolts, so as to facilitate its disassembly for cleaning or repair. More particularly, the drawing unit 15 comprises a head block 34 which extends along the two sides and ends of the slot 16. Along the sides of the slot 16, each head block 34 is composed of a base plate 35, a central plate 36, and a top plate 37, which are interconnected by a number of vertical bolts 38. The outer side edge of the top plate 37 mounts a cover plate 39 by means of bolts 40, and for the purposes described below. Also, the base plate 35 of each head block 34 mounts a depending plate 42, which includes three longitudinally extending reinforcing rails 44 mounted on the outside surface thereof.

Each top plate 37 includes a side edge surface which defines one of the upper side wall segments 21, 22 of the upper slot segment 20, with the upper corner of the side edge surface being arcuately curved in cross section as best seen in FIG. 3. The central plate 36 and the depending plate 42 on each side of the slot include side wall surfaces which are coplanar and define one of the lower side wall segments 25, 26 of the lower slot segment 24.

Each nozzle 30 comprises an elongate outlet 46 communicating with a respective one of the shoulders 28 and extending along the full longitudinal length of the slot 16. An air passageway 48 extends through each of the head blocks 34 to supply pressurized air to the associated nozzle, and each passageway 48 is defined by a first wall surface 49 formed on the bottom of the top plate 37, and a mating second wall surface 50 formed on the top of the central plate 36. These wall surfaces 49, 50 extend along the length of the slot 16 and they are spaced apart so as to define, when viewed in transverse cross section as seen in FIG. 3 an air passageway 48. The air passageway 48 is composed of a discharge segment 52 communicating with the outlet 46 at the associated shoulder 28, and a rearward segment 53 which has a serpentine configuration of smoothly and gradually reducing width in the direction moving toward the associated outlet 46. The rearward segment of the air passageway comprises at least two parallel vertical sections and an arcuately curved section between each pair of vertical sections.

The discharge segment 52 of the air passageway of each nozzle comprises opposing parallel and laterally spaced apart vertical wall surface segments 55, 56, with the surface segment 55 being coplanar with the associated lower side wall segment 26 of the slot 16.

As best seen in FIG. 3, the rearward segment 53 of each air passageway 48 comprises, in the illustrated embodiment, three parallel vertical sections and an arcuately curved U-shaped section between each adjacent pair of vertical sections.

Each air passageway 48 further comprises a relatively large air distribution chamber 59 extending along a direction parallel to the longitudinal direction of the slot 16, and which is formed between the outer side edge of the top plate 37 and the cover plate 39. Compressed air is fed to the chamber 59 through a plurality of inlet ducts 60, and an air filter 62 is mounted between the outer side edge of the top plate 37 and the cover plate 39 for filtering the delivered air. The compressed air is delivered to the inlet ducts via a manifold line 63, which is connected to a suitable air supply 64, note FIG. 1.

Each air passageway 48 further comprises a plurality of separate air lines 66 extending between the distribution chamber 59 and the serpentine rearward segment 53 of the associated air passageway 48. The number of air lines 66 should be several times more than the number of inlet ducts 60, and the diameter of the air lines 66 is preferably several times less than the diameter of the inlet ducts 60. The air lines 66 thus create an air pressure drop which serves to equalize the air pressure and speed along the length of the passageway 48. In this regard, it will be understood that the serpentine configuration of the rearward segment 53 further serves to equalize the air speed and flow rate along the length of the passageway 48, and thus along the complete length of the outlet 46 of the nozzle 30. Further, the fact that the serpentine rearward segment 53 is of smoothly and gradually reducing width results in minimum turbulence in the air as it moves toward the outlet of the nozzle.

As a further feature of the illustrated embodiment of the drawing unit, the lower edges of the upper side wall segments 21, 22 are each inclined outwardly at an angle $\alpha$ of between about 5 to 10 degrees, note FIG. 4, so as to define an outwardly flared lower end portion of the upper slot segment 20. This flared end portion avoids wear at the corner of the shoulder 28, and facilitates cleaning of the slot.

In one specific and non-limiting example of the present invention, the upper slot segment 20 of the drawing unit 15 has a width of about 2 to 10 mm, and the lower slot segment 24 has a width of about 4 to 14 mm. The discharge segment 52 of the nozzle 30 has a width of about 0.1 to 2.0 mm, and the air speed through the discharge segment is about 5000 to 22000 m/min. The distance from the open upper end 18 of the slot to the shoulder 28 is about 20 to 40 mm, and the distance from the shoulder to the lower exit end of the slot 16 is about 0.5 to 2.5 m. The air streams introduced by the nozzles 30 serve to draw or suck in air through the upper slot segment 20, and this induced air flow reaches a maximum speed when it merges with the air entering through the nozzles 30. This maximum speed is believed to be close to the air speed at the slot exit, which is about 1500 to 7000 m/min. The resulting filaments typically have a denier of about 1.5 to 4.0.

The illustrated construction of the drawing unit 15 facilitates the adjustment and disassembly of the unit. Specifically, the apertures in the top plate 37 and central plate 36 for receiving the vertical bolts 38 are oversized, so as to permit the lateral positioning of the top plate 37 to be adjusted with respect to the base plate 35 and the central plate 36, which thereby permits adjustment of the width of the upper slot segment 20 and the width of the discharge segment 52 of the nozzle.

In operation, the spinneret 12 extrudes a plurality of polymeric filaments F in the form of a downwardly advancing vertical curtain, and the filaments of the sheet are cooled by contact with air immediately below the spinneret. The advancing filaments then pass through the drawing unit 15, which serves to draw the filaments by contacting the filaments with a relatively non-turbulent flow of air which is moving downwardly in a direction parallel to the advance of the curtain and at a speed greater than that of the advancing curtain. The absence of significant turbulence in the air flow serves to uniformly and consistently apply the drawing force to the filaments, resulting in a uniform and predictable draw of the filaments. Finally, the filaments are deposited onto the moving belt 32, which forms a web of the material. Subsequently, the filaments may be bonded to each other at their contact points by any one of a number of well-known techniques, to form a so-called spunbond fabric web.

In the drawings and specification, there has been set forth a preferred embodiment of the invention, and although specific terms are employed, they are used in a generic and descriptive sense only and not for purposes of limitation.

That which is claimed is:

1. An apparatus for forming a nonwoven fabric web comprising melt spinning means including a spinneret for extruding a plurality of continuous polymeric filaments, filament drawing means defining a longitudinal elongate slot positioned below said spinneret for receiving and drawing the filaments therein, said slot having a vertical length and a longitudinal length, said means defining said slot including a horizontally directed elongate open upper end and opposing side walls depending substantially vertically downwardly from said open end, and nozzle means having an outlet communicating with said slot longitudinally along at least one of said side walls at a medial location along the vertical length of said slot for introducing a downwardly directed stream of air into said slot along substantially the entire longitudinal length of said slot at a location immediately adjacent said one side wall and in a direction which is essentially parallel to said one side wall so that air is drawn into the upper end of said slot and the drawn-in air and the air introduced by said nozzle means form a relatively non-turbulent flow along the vertical length of said slot which exerts a drawing force on the filaments as they pass vertically through said slot, said nozzle means further comprising first and second wall surfaces which extend along the longitudinal length of said slot, with said first and second wall surfaces being spaced apart so as to define, when viewed in transverse cross section, an air passageway which is composed of a discharge segment communicating with said outlet and a rearward segment which has a serpentine configuration of smoothly and gradually reducing width in the direction moving toward said outlet, and moving belt means positioned below said slot for receiving the filaments and forming the same into a nonwoven fabric web.

2. The apparatus as defined in claim 1 wherein at least one of said side walls of said means defining said slot includes an upper side wall segment, a lower side wall segment which is parallel to and transversely offset from said upper side wall segment, and a transverse shoulder formed between said upper and lower side wall segments, and wherein said outlet of said nozzle means communicates with said slot at said shoulder.

3. The apparatus as defined in claim 2 wherein said wall surfaces of said discharge segment of said air passageway are parallel to each other and laterally spaced apart with one of said wall surfaces of said discharge segment being coplanar with said one side wall.

4. The apparatus as defined in claim 1 wherein said serpentine configuration of said rearward segment includes at least two oppositely curved U-shaped sections.

5. An apparatus for forming a nonwoven fabric web comprising melt spinning means including a spinneret for extruding a substantially vertical curtain of continuous polymeric filaments, filament drawing means defining a longitudinal elongate slot positioned below said spinneret for receiving and drawing the filaments therein, said slot having a vertical length and a longitudinal length, said means defining said slot including a horizontally directed elongate open upper end, an upper slot segment depending from said open upper end and comprising a pair of relatively closely spaced apart, vertically directed upper side wall segments, a lower slot segment depending from said upper slot segment and comprising a pair of relatively widely spaced apart, vertically directed lower side wall segments, and a transverse shoulder positioned between the upper and lower side wall segments on each side of said slot, a pair of nozzle means each having an outlet communicating with the slot at a respective one of said shoulders, with each of said nozzle means adapted for introducing a downwardly directed stream of air into said slot along substantially the entire longitudinal length of said slot at a location immediately adjacent the associated lower side wall segment and in a direction which is essentially parallel to the associated lower side wall segment so that air is drawn into the upper end of said slot and the drawn-in air and the air introduced by said nozzle means form a relatively non-turbulent flow along the vertical length of said slot which exerts a drawing force on the filaments as they pass vertically through said slot, each of said nozzle means further comprising first and second wall surfaces which extend along the longitudinal length of said slot, with said first and second wall surfaces being spaced apart so as to define, when viewed in transverse cross section, an air passageway which is composed of a discharge segment communicating with the associated outlet and a rearward segment which has a serpentine configuration of smoothly and gradually reducing width in the direction moving toward the associated outlet, and moving belt means positioned below said slot for receiving the filaments and forming the same into a nonwoven fabric.

6. The apparatus as defined in claim 5 wherein said wall surfaces of said discharge segment of said air passageway of each of said nozzle means are parallel to each other and laterally spaced apart with one of said wall surfaces of said discharge segment being coplanar with the associated lower side wall segment.

7. The apparatus as defined in claim 6 further comprising means for adjusting the lateral separation of said parallel wall surfaces of said discharge segment of each of said nozzle means.

8. The apparatus as defined in claim 6 wherein each of said nozzle means further comprises a relatively large air distribution chamber extending along a direction parallel to the elongate direction of said slot, and a plurality of separate air lines extending between said distribution chamber and said rearward segment of the associated air passageway.

9. The apparatus as defined in claim 8 wherein each of said nozzle means further comprises air delivery means for delivering compressed air to the associated air distribution chamber, and including air filtration means for filtering the delivered air.

10. The apparatus as defined in claim 6 wherein said rearward segment of said air passageway of each of said nozzle means comprises at least two parallel vertical sections and an arcuately curved section between each adjacent pair of vertical sections.

11. The apparatus as defined in claim 5 wherein the lower edges of said upper side wall segments of said upper slot segment are each inclined outwardly from the center of said slot at an angle of between about 5 degrees and 10 degrees to define an outwardly flared lower end portion of the upper slot segment.

12. An apparatus for downwardly drawing a curtain of polymeric filaments, a pair of side by side head blocks which are positioned so as to define a longitudinal elongate slot therebetween, said slot having a vertical length and a longitudinal length and including a horizontally directed elongate open upper end, and with said head blocks including an upper slot segment depending from said open upper end and comprising a pair of relatively closely spaced apart, vertically directed upper side wall segments, a lower slot segment depending from said upper slot segment and comprising a pair of relatively widely spaced apart, vertically directed lower side wall segments, and a transverse shoulder positioned between the upper and lower side wall segments on each side of said slot, a pair of nozzle means mounted in respective ones of said head blocks, with each of said nozzle means having an outlet communicating with the slot at a respective one of said shoulders and being adapted for introducing a downwardly directed stream of air into said slot along substantially the entire longitudinal length of said slot at a location immediately adjacent the associated lower side wall segment and in a direction which is essentially parallel to the associated lower side wall segment, so that air is drawn into the upper end of said slot and the drawn-in air and the air introduced by said nozzle means form a relatively non-turbulent flow along the vertical length of said slot which exerts a drawing force on the filaments as they pass vertically through said slot, each of said nozzle means further comprising first and second wall surfaces formed interiorly of the associated head block and which extend along the longitudinal length of said slot, with said first and second wall surfaces being spaced apart so as to define, when viewed in transverse cross section, an air passageway which is composed of a discharge segment communicating with the associated outlet and a rearward segment which has a serpentine configuration of smoothly and gradually reducing width in the direction moving toward the associated outlet.

13. The apparatus as defined in claim 12 wherein said wall surfaces of said discharge segment of said air passageway of each of said nozzle means are parallel to each other and laterally spaced apart with one of said wall surfaces of said discharge segment being coplanar with the associated lower side wall segment.

14. The apparatus as defined in claim 13 wherein each of said head blocks includes a central plate and a top plate overlying and mounted to said central plate, and wherein said first and second wall surfaces are defined by the opposing surfaces of said central and top plates.

15. The apparatus as defined in claim 14 wherein said top plate of each head block includes a relatively large air distribution chamber extending along a direction parallel to the elongate direction of said slot, and a plurality of separate air lines extending between said distribution chamber and said rearward segment of the associated air passageway.

16. The apparatus as defined in claim 14 wherein said top plate of each head block is laterally adjustable with respect to the associated central plate so as to permit adjustment of the lateral separation of said parallel wall surfaces of said discharge segment of the associated nozzle means.

17. The apparatus as defined in claim 12 wherein said rearward segment of said air passageway of each of said nozzle means comprises at least two parallel vertical sections and an arcuately curved section between each adjacent pair of said vertical sections.

* * * * *